US011582567B2

(12) United States Patent
Kvist

(10) Patent No.: US 11,582,567 B2
(45) Date of Patent: Feb. 14, 2023

(54) HEARING DEVICE WITH AN ANTENNA

(71) Applicant: GN Hearing A/S, Ballerup (DK)

(72) Inventor: Søren Helstrup Kvist, Vaerlose (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 17/202,348

(22) Filed: Mar. 16, 2021

(65) Prior Publication Data

US 2021/0306773 A1 Sep. 30, 2021

(30) Foreign Application Priority Data

Mar. 30, 2020 (EP) ..... 20166544

(51) Int. Cl.

| | |
|---|---|
| ***H04R 25/00*** | (2006.01) |
| ***H01Q 1/27*** | (2006.01) |
| ***H01Q 1/38*** | (2006.01) |
| ***H01Q 1/48*** | (2006.01) |

(52) U.S. Cl.

CPC ..... *H04R 25/554* (2013.01); *H01Q 1/273* (2013.01); *H01Q 1/38* (2013.01); *H01Q 1/48* (2013.01); *H04R 25/602* (2013.01); *H04R 25/609* (2019.05); *H04R 2225/025* (2013.01); *H04R 2225/51* (2013.01)

(58) Field of Classification Search

CPC .. H04R 25/554; H04R 25/602; H04R 25/609; H04R 2225/025; H04R 2225/51; H04R 3/00; H01Q 1/273; H01Q 1/38; H01Q 1/48

See application file for complete search history.

(56) References Cited

U.S. PATENT DOCUMENTS

| | | | | |
|---|---|---|---|---|
| 7,652,628 | B2 * | 1/2010 | Zweers | H05K 1/189 343/702 |
| 10,827,249 | B1 * | 11/2020 | Pine | H04R 1/1041 |
| 10,972,824 | B1 * | 4/2021 | Tseng | H04R 1/1058 |
| 11,206,499 | B2 * | 12/2021 | Shenoy | H04R 25/554 |

(Continued)

FOREIGN PATENT DOCUMENTS

EP 3185583 A1 6/2017

OTHER PUBLICATIONS

European Search Report dated Aug. 28, 2020 for related EP Appln. No. 20166544.5.

*Primary Examiner* — Angelica M McKinney
(74) *Attorney, Agent, or Firm* — Vista IP Law Group, LLP

(57) ABSTRACT

A hearing device is configured to be worn in an ear of a user, and is configured to provide an audio signal to the user. The hearing device comprises a circuit assembly. The circuit assembly comprises a printed circuit board assembly. The printed circuit board assembly comprises a first circuit board, a second circuit board, and a third circuit board between the first and second circuit boards. The circuit assembly comprises a battery, wherein the printed circuit board assembly is folded about the battery; and an antenna comprising an antenna element, the antenna being configured for emission and reception of electromagnetic radiation at a wavelength (λ); wherein the antenna element has a first end connected to a feed, wherein the feed is provided in a portion of the first or third circuit board which is adjacent an interconnection between the first and third circuit boards.

17 Claims, 10 Drawing Sheets

(56) References Cited

U.S. PATENT DOCUMENTS

| | | | | |
|---|---|---|---|---|
| 2011/0210898 | A1* | 9/2011 | Choi | H01P 11/00 343/904 |
| 2016/0050474 | A1* | 2/2016 | Rye | H05K 7/1427 381/152 |
| 2017/0180884 | A1* | 6/2017 | Ozden | H04R 25/554 |
| 2018/0034135 | A1* | 2/2018 | Kwak | H01Q 9/42 |
| 2018/0242074 | A1* | 8/2018 | Xu | H01Q 1/273 |
| 2018/0254546 | A1* | 9/2018 | Shamsoddini | H04B 1/385 |
| 2020/0100036 | A1* | 3/2020 | Kvist | H01Q 13/10 |

* cited by examiner

HEARING DEVICE WITH AN ANTENNA

RELATED APPLICATION DATA

This application claims priority to, and the benefit of, European Patent Application No. EP 20166544.5 filed on Mar. 30, 2020. The entire disclosure of the above application is expressly incorporated by reference herein.

FIELD

The present disclosure relates to a hearing device having wireless communication capabilities, thus a hearing device having an antenna for communication. The hearing device is configured to be worn in an ear of a user and the hearing device is configured to provide an audio signal to the user.

BACKGROUND

Hearing devices are used more and more by all kinds of people. Hearing devices may be used for listening to music, having phone calls etc. Hearing devices may be hearing aids used for compensating a hearing loss of the user.

Small and compact wireless hearing devices are gaining popularity as they are easy to bring along in a bag or pocket, comfortable to wear and visually appealing.

US2016050474A discloses a circuit assembly including a printed circuit board assembly. The printed circuit board assembly includes a first circuit board, a second circuit board, and a first flexible substrate interposed between, and continuous with, the first circuit board and the second circuit board. A second flexible substrate extends from, and is continuous with, the second circuit board. One or more electronic circuits comprising electronic components are disposed along one or more of the first circuit board or the second circuit board. The printed circuit board assembly is folded about a battery, with the first circuit board adjacent to the first major face, the second circuit board adjacent to the second major face, and the first flexible substrate spanning the one or more side faces.

Hearing devices have over the later years been increasingly able to communicate wirelessly with the surroundings, including communicating with other hearing devices, remote controls and other external electronic devices, including smart phones.

To fulfil the above requirements, the hearing device need to comprise many electronic and metallic components contained in a housing small enough to fit in an ear of a user.

The many electronic and metallic components in combination with the small size of hearing device housing impose high design constraints on the radio frequency antennas to be used in hearing devices with wireless communication capabilities.

Thus, there is a need for an improved small and compact hearing device with an antenna, typically radio frequency antenna, designed to achieve connectivity with a wide range of devices to obtain good communication for all sizes and shapes of heads, ears and hair, in all environments and with as large frequency bandwidth as possible despite the space limitation and other design constraints imposed by the size requirements of the hearing device.

SUMMARY

It is an object to overcome at least some of the disadvantages as mentioned above, and it is a further object to provide a hearing device with increased wireless communication capabilities.

Disclosed is a hearing device configured to be worn in an ear of a user. The hearing device is configured to provide an audio signal to the user. The hearing device comprises a circuit assembly. The circuit assembly comprises a printed circuit board assembly. The printed circuit board assembly comprises a first circuit board. The printed circuit board assembly comprises a second circuit board. The printed circuit board assembly comprises a third circuit board. The third circuit board is provided between the first circuit board and the second circuit board. The third circuit board is interconnected with the first circuit board and the second circuit board. The circuit assembly comprises a battery. The printed circuit board assembly is folded about the battery. The circuit assembly comprises an antenna. The antenna comprises an antenna element. The antenna is configured for emission and reception of electromagnetic radiation at a wavelength ($\lambda$). The antenna element has a first end. The first end is connected to a feed. The feed is provided in a portion of the first circuit board which is adjacent the interconnection between the first and third circuit boards, or the feed is provided in a portion of the third circuit board which is adjacent the interconnection between the first and third circuit boards.

The hearing device as disclosed provides that the feed of the antenna or antenna element is provided in a portion of the first or third circuit board which is adjacent the interconnection between the first and third circuit boards. Thereby the antenna element may excite a mode on the printed circuit board assembly. Furthermore, the third circuit board may be a high-current or a maximum-current area. In other words, the printed circuit board assembly may be considered to be part of the antenna, and the current distribution of the antenna during use may have a maximum current at the third circuit board. It is an advantage as this provides an improved antenna performance. Thus, it is an advantage that a hearing device with increased wireless communication capabilities is provided.

The printed circuit board assembly folded about the battery provides that the hearing device can be small and compact. It is a further advantage that the hearing device as disclosed provides a small and compact hearing device. Thus, it is an advantage that a small and compact hearing device with increased wireless communication capabilities is provided.

The hearing device may be a wireless communication device for wireless communication with other electronic devices or users. The hearing device may be a headset for listening to music, performing phone calls etc. The hearing device may be an ear phone, ear bud, ear piece or an in-ear head phone. The hearing device may be a hearing aid configured to provide an audio signal for compensating for a hearing loss of the user. The hearing device may be configured to be comprised in a set of hearing devices, such that the user can wear a hearing device in each ear. The set of hearing devices may form a binaural hearing device. The hearing device may be calibrated with respect to the other hearing device in the set of hearing devices, and vice versa. The set of hearing devices may communicate wirelessly with each other and the set of hearing devices may communicate wirelessly with one or more external devices, e.g. such as a remote control or the user's phone.

The hearing device is configured to be worn in an ear of a user. The hearing device may be arranged in the outer ear of the user. The hearing device may be arranged outside the ear canal of the user. The hearing device may be arranged at the concha of the ear. The hearing device may be arranged adjacent the tragus of the ear.

The hearing device is configured to provide an audio signal to the user. The audio signal may be provided to the user's ear canal through an output transducer in the hearing device. The audio signal may be processed in a processing unit of the hearing device. The audio signal may be inputted in the hearing device through a microphone in the hearing device, for example if the hearing device is a hearing aid for compensating a hearing loss of the user. The audio signal may be inputted in the hearing device through streaming from or connection to another device, such as from a telephone, mobile phone, television, electronic device etc. The audio signal may be sounds, surrounding sounds, speech from other people, music, a telephone call, media streaming etc.

The hearing device comprises a circuit assembly. The circuit assembly may mechanically support and electrically connect electronic components using conductive tracks, pads and other features etched from one or more sheet layers of copper laminated onto and/or between sheet layers of a non-conductive substrate. The combination of components and wires allows various simple and complex operations to be performed: signals can be amplified, computations can be performed, and data can be moved from one place to another. The circuit assembly may comprise an electronic circuit. The circuit assembly may comprise one or more printed circuit boards. Each of the one or more printed circuit boards may mechanically support and electrically connect electronic components using conductive tracks, pads and other features etched from one or more sheet layers of copper laminated onto and/or between sheet layers of a non-conductive substrate. Electronic components, such as resistors, transistors, capacitors, inductors and diodes, are typically soldered onto the printed circuit board to both electrically connect and mechanically fasten them to it. A printed circuit board may typically be a single-sided (one copper layer), double-sided (two copper layers on both sides of one substrate layer), or multi-layer (outer and inner layers of copper, alternating with layers of substrate) printed circuit board.

The circuit assembly comprises a printed circuit board assembly. The printed circuit board assembly comprises a first circuit board. The printed circuit board assembly comprises a second circuit board. The printed circuit board assembly comprises a third circuit board. The third circuit board is provided between the first circuit board and the second circuit board. The third circuit board is interconnected with the first circuit board and the second circuit board. Thus, the printed circuit board assembly comprises three circuit boards which are connected, such as interconnected, with each other. The first and second printed circuit boards may be multi-layer printed circuit boards with multiple layers, such as 4, 5, 6, 7 or 8 layers. The third circuit board may be a multi-layer printed circuit boards with multiple layers, such as 2, 3, 4, 5, or 6 layers. The third circuit board may have fewer layers than the first and second circuit boards.

The three circuit boards may be different circuit boards, such as printed circuit boards and/or flexible circuit boards. One of more of the first, second, third, and fourth circuit boards may be integrally made, i.e. made from one printed circuit board device comprising sections which provides one or more of the first, second, third, and fourth circuit boards.

If the circuit board is a flexible circuit board, there may be e.g. 2 layers of material. A flexible circuit board is flexible and bendable. A flexible circuit board may be made of soft and bendable plastic or other flexible material.

The third circuit board may be shaped in different ways. The third circuit board may for example be straight or curved. The third circuit board may have an elongated shape. The first and second circuit boards may be shaped as traditional printed circuit boards, e.g. rectangular, oval, circular etc.

The printed circuit board assembly, when unfolded, may have a length in a first direction of less than 70 mm, such as less than 60 mm, such as less than 50 mm, such as less than 40 mm, such as less than 35 mm. The printed circuit board assembly, when unfolded, may have a length in a second direction of less than 70 mm, such as less than 60 mm, such as less than 50 mm, such as less than 40 mm, such as less than 35 mm. The first direction of the printed circuit board assembly may be perpendicular to the second direction of the printed circuit board assembly.

Each of the individual circuit boards, i.e. the first, second, and/or third circuit board may each have a length in a first direction of less than 30 mm, such as less than 20 mm, such as less than 15 mm. Each of the individual circuit boards, i.e. the first, second, and/or third circuit board may each have a length in a second direction of less than 30 mm, such as less than 20 mm, such as less than 15 mm. The first direction of each circuit board may be perpendicular to the second direction of the circuit board.

The circuit assembly comprises a battery. The battery provides power to the circuit assembly and thus to the hearing device. The battery may be a rechargeable battery, which shall not be replaced in the hearing device, but which can remain in the hearing device for the entire life time of the hearing device, or for more years etc. The battery may be recharged by placing the hearing device with the battery in a charging device, such as a charging case. The rechargeable battery may be a lithium-ion battery, a silver-zinc battery, etc. The battery may be shaped as a cylinder. The battery may be shaped as a rectangular box. The battery may be a disc-shaped/cylindrical battery. The battery may be button-type battery. The battery may be flat. The battery may have a length/diameter of less than 10 mm, such as less than 8 mm, such as less than 6 mm, such as less than 4 mm. The battery may have a height/thickness of less than 10 mm, such as less than 8 mm, such as less than 6 mm, such as less than 4 mm, such as less than 2 mm. The voltage provided by the battery may typically be 1.0-4.0 V, such as 1.4 V, 1.45, or 3.6±0.1 V. The battery typically provides direct current (DC).

The printed circuit board assembly is folded about the battery. The third circuit board, which may be a flexible circuit board, may comprise one or more bends, such that the entire printed circuit board assembly can surround, enclose, encase the battery.

The printed circuit board assembly may be a rigid-flex circuit, i.e. a hybrid construction flex circuit consisting of rigid and flexible substrates which are laminated together into a single structure. The first, second, and/or fourth circuit board(s) may be rigid circuit board(s), while the third circuit board is flexible, whereby the flexible structure of the third circuit board allows the printed circuit board assembly to be folded about the battery. The third circuit board has a thickness (t). The bend radius of the third circuit board may be smaller than 5 mm or smaller than 150×(t).

Alternatively, the third circuit board may also be a rigid circuit board, and the first, second, third, and/or fourth circuit board(s) may be interconnected by means of flexible sections with a bend radius of less than 5 mm. In an embodiment, the first, second, and/or fourth circuit board(s)

have a larger bend radius than the third printed circuit board and/or than the flexible sections.

The circuit assembly comprises an antenna. The antenna may be an electrical antenna. The antenna may be an radio frequency (RF) antenna. The antenna may be a resonant antenna. The antenna may be interconnected with a wireless communication unit for emission and reception of an electromagnetic field. The wireless communication unit may be a radio. The wireless communication unit may be a transceiver or a radio.

The antenna comprises an antenna element. The antenna may comprise an antenna structure. The antenna element may be a part of the antenna structure. The antenna element may be an electric antenna or antenna element. The antenna element may be a resonant antenna or antenna element. The antenna element may be an RF antenna or antenna element. The antenna element may be a monopole antenna or antenna element. The antenna element may be a loop antenna or antenna element. The antenna element may be formed by a conductive material, such as a conductive metal wire. The antenna element may be formed by an elongated conductive material.

The antenna is configured for emission and reception of electromagnetic radiation at a wavelength (λ). Thus, the antenna may be configured to operate at the wavelength (λ). The wavelength (λ) may correspond to a frequency. The electromagnetic radiation or field emitted and received by the antenna may be described as a signal having a bandwidth characterized by a center wavelength or a center frequency, respectively.

The antenna may be configured to operate in a first frequency range, such as at a frequency above 1 GHz, such as at a frequency between 1.5 GHz and 6 GHz, during use. The antenna may be configured to operate at a first frequency, such as at a frequency of 1.6 GHz, such as at a frequency of 2.45±0.05 GHz, such as at a frequency of 5.8±0.075 GHz, during use. The first frequency may be the center frequency characterizing a bandwidth, such that the first frequency may be the center frequency of for example 2.4 GHz, while the bandwidth ranges for example from 2.0 GHz-2.8 GHz. Thus, the antenna may be configured for operation in ISM frequency band, such as a GSM band or a WLAN band comprising any one or more of these frequencies. However, it is envisaged that the hearing device as herein disclosed is not limited to operation in such a frequency band, and the hearing device may be configured for operation in any frequency band.

At least a part of the antenna element is provided at the first circuit board. At least a part of the antenna element may be provided at the first surface of the first circuit board. The antenna element may be provided, such as mounted or arranged, on the first circuit board. The antenna element may be provided as an implemented part of the first circuit board. The antenna element may be implemented as a signal trace on the first circuit board. The antenna element may be separate antenna element connected to first circuit board.

The antenna element has a first end. The first end is connected to a feed of the antenna element. The feed may be a feeding point or a excitation point. The feed may connect the antenna or the antenna element to the wireless communication unit, such as a radio or a transceiver. The feed may be the location where the antenna or antenna element is connected to the wireless communication unit, such as a radio or a transceiver.

The feed is provided in a portion of the first circuit board which is adjacent the interconnection between the first and third circuit boards. Alternatively, the feed is provided in a portion of the third circuit board which is adjacent the interconnection between the first and third circuit boards. In other words, regardless of whether the feed is provided in a portion of the first or third circuit board, respectively, the feed may be provided close to or next to the interconnection between the first and third circuit boards.

In some embodiments, the antenna element extends from the feed onto the first circuit board. The antenna element may extend along a perimeter of at least a part of the first circuit board.

In some embodiments, the distance from the feed to the interconnection between the first and third circuit boards is less than 5 mm, such as less than 4 mm, 3 mm. In some embodiments, the distance from the feed to the interconnection between the first and third circuit boards is less than λ/24, such as less than λ/32, λ/44.

In some embodiments, the feed is provided in a portion of the first circuit board which is adjacent the third circuit board.

In some embodiments, at least a part of the antenna element is printed on the first circuit board. In some embodiments, the at least a part of the antenna element is printed as a trace on the first circuit board. It is an advantage as this may save cost.

In some embodiments, at least a part of the antenna element is provided at the first circuit board.

In some embodiments, the antenna element extends across a first surface of the first circuit board. The antenna element may have an elongated shape that extends across a first surface of the first circuit board. The first surface of the first circuit board may be provided opposite a second surface of the first circuit board. The second surface may point or be orientated toward the battery. The first surface may point or be orientated toward the surroundings or may be facing outwards away from the user's ear, then the hearing device is arranged in operational use in the ear of the user.

In some embodiments, the antenna element has a second end. In some embodiments, the second end is connected to an end point provided at the first circuit board. In some embodiments, the second end is connected to an end point provided at the third circuit board. Alternatively, the second end may be a free end.

In some embodiments, the end point is provided in a portion of the first board which is adjacent the interconnection between the first and third circuit boards. In some embodiments, the end point is provided in a portion of the third board which is adjacent the interconnection between the first and third circuit boards. In other words, regardless of whether the end point is provided in a portion of the first or third circuit board, respectively, the end point may be provided close to or next to the interconnection between the first and third circuit boards.

In some embodiments, the feed of the antenna element is configured to excite the second circuit board. In some embodiment, the feed of the antenna element is configured to excite the third circuit board. In other words, due to the location of the feed adjacent the interconnection between the first and third circuit boards element, the antenna element may excite a mode on the printed circuit board assembly. The mode may be present on both the third circuit board and the second circuit board. It is an advantage that the feed or the antenna may excite the second and third circuit boards, as the antenna performance may be improved.

In some embodiments, the third circuit board is connected to the first circuit board in proximity of the feed.

In some embodiments, the second end of the antenna element is connected to a ground plane. Thus, the second end may be connected to an end point provided at the first or third circuit board, and the end point may be connected to the ground plane. The second end, which is connected to the ground plane, may be located adjacent the interconnection between the first and third circuit boards. If the antenna or antenna element is a loop antenna or antenna element, the antenna or antenna element may be a ground-connected loop, where the ground connection is located near or adjacent the interconnection between the first and third circuit boards. The ground plane may be the ground plane of the hearing device. The ground plane may be the ground plane of the first circuit board. The ground plane may be the printed circuit board assembly. A transmission line may connect the second end of the antenna to the ground plane. Alternatively, the second end is not connected to the ground plane. It is an advantage having the second end of the antenna element connected to a ground plane as the antenna performance may be improved.

In some embodiments, the second end of the antenna element is connected to the ground plane through a first electronic component. Thus, the second end may be connected to an end point provided at the first or third circuit board, and the end point may be connected to the ground plane through or via the first electronic component. The first electronic element may be provided between the second end and the ground plane. The first electronic component may be a resistor, capacitor, inductor, diode or a transistor, etc. The first electronic component may be configured to change one or more characteristics of the antenna or the antenna element, such as the electrical length. The first electronic component may be an antenna shortening/lengthening component in the form of a capacitance or an inductance. This provides that the electrical length of the antenna or of the antenna element may be altered. This may also provide that a resonance frequency of the antenna or of the antenna element may be altered. The first electronic component may be a impedance matching component. This provides an impedance matching between the antenna or the antenna element and the wireless communication unit, thereby optimizing the power transfer. The first electronic component may be configured to change the current distribution along the antenna or antenna element, such as changing where the current is highest along the antenna or antenna element, or in other words, changing where the current distribution has a maximum current amplitude along the antenna or antenna element. Thus, the first electronic component may change one or more characteristics of the antenna or antenna element, such that the characteristic of the antenna may be changed to improve the antenna performance. Thus, it is an advantage that the antenna performance may be improved.

In some embodiments, the antenna element is configured to have an electrical length corresponding to about $\lambda/2$. Thus, the electrical length of the antenna element may correspond to about half a wavelength of the of the electromagnetic field to be emitted and received by the antenna.

In some embodiments, the antenna element is configured to have an electrical length corresponding to about $\lambda/4$ to $\lambda/2$. Thus, the electrical length of the antenna element may correspond to about a quarter to a half of a wavelength of the of the electromagnetic field to be emitted and received by the antenna.

In some embodiments, the first and second circuit boards are printed circuit boards. In some embodiment, the third circuit board is a flexible circuit board. The printed circuit boards may comprise more layers, such as six layers. The printed circuit board may be hard. The printed circuit boards may comprise electronic components, such as resistors, transistors, capacitors, inductors and diodes, connected by conductive wires or traces through which electric current can flow. The flexible circuit board may comprise one or more layers, such a two layers. The flexible circuit board is flexible and bendable. The flexible circuit board is soft and may not break if bended. The flexible circuit board may comprise conductive wires or traces through which electric current can flow. One or more of the printed circuit boards are connected with the flexible circuit board. The conductive wires or traces of one or more of the printed circuit boards are connected with or extends as the conductive wires or traces of the flexible circuit board.

In some embodiments, the third circuit board has a width. In some embodiments, the third circuit board is connected to the first and the second circuit boards along it entire width. This provides improved strength and stability of the connection between the third circuit board and the other circuit boards. The third circuit board may also have a length and a thickness.

In some embodiments, the battery comprises a first major face, a second major face and one or more side faces. In some embodiments, the printed circuit board assembly is folded about the battery. In some embodiments, the printed circuit board assembly is folded about the battery with the first circuit board adjacent the first major face, the second circuit board adjacent the second major face, and the third circuit board adjacent to one or more of the one or more side faces. In other words, the printed circuit board assembly may be bent or wrapped around the battery.

Thus, the first major face and the second major face of the battery may be opposite each other. The third circuit board may be adjacent at least one of the one or more side faces of the battery. The battery may be shaped as a cylinder. The cylinder may be a circular cylinder, and/or a right cylinder. The first and second major face of the battery may correspond to the two bases of a cylinder. The side face of the battery may correspond to the lateral area of a cylinder. If the battery is shaped as a cylinder, the battery may only have one side face, and the third circuit board is adjacent a part of the side face of the battery.

The surface of the circuit board pointing towards the battery, when the printed circuit board assembly is folded about the battery, may be the second surface of the circuit board. The surface of the circuit board pointing towards the surroundings, when the printed circuit board assembly is folded about the battery, may be the first surface of the circuit board. Thus, the second surface of the first circuit board is opposite the second surface of the second circuit board. The second surface of the first circuit board may be adjacent the first major face of the battery. The second surface of the second circuit board may be adjacent the second major face of the battery.

In some embodiments, the hearing device further comprises a first distance between the first major face of the battery and the first circuit board, the first distance having a first predefined value. In some embodiments, the hearing device comprises a second distance between the second major face of the battery and the second circuit board, the second distance having a second predefined value. The first and second distance provides an air gap between the circuit board and the battery. The antenna performance is further improved when there is this distance/air gap between the circuit board and the battery. Computer simulations show that when there is a distance/air gap, the antenna performance is improved. The surface of the circuit board pointing towards the battery, when the printed circuit board assembly is folded about the battery, may be the second surface of the circuit board. The surface of the circuit board pointing towards the surroundings, when the printed circuit board assembly is folded about the battery, may be the first surface of the circuit board. Thus, the second surface of the first circuit board is opposite the second surface of the second circuit board. The first distance may be between the first major face of the battery and the second surface of the first circuit board. The second distance may be between the second major face of the battery and the second surface of the second circuit board.

In some embodiments, the first distance is 200-400 micrometer, preferably about 300 micrometer. In some embodiments, the second distance is 200-400 micrometer, preferably about 300 micrometer. The first distance and the second distance may be the same or different distances. The antenna performance is further improved when the distance is 200-400 micrometer, preferably about 300 micrometer. Computer simulations show that at these distances, the antenna performance is optimal.

In some embodiments, the battery is connected to the printed circuit board assembly through a second electronic component. Preferably, the second electronic component may be an inductor.

In some embodiments, the second electronic component is configured to electrically decouple the battery and the printed circuit board assembly at a first frequency, corresponding to the wavelength (λ), while maintaining an electrical connection between the battery and the printed circuit board assembly at second frequencies. The first frequency may be different from the second frequencies. For example, the first frequency may be 2.45±0.05 GHz, while the second frequencies may the frequencies different from 2.45±0.05 GHz.

In some embodiments, the hearing device further comprises a wireless communication unit interconnected with the antenna element. In some embodiments, the wireless communication unit is configured for wireless communication, including wireless data communication, and is in this respect interconnected with the antenna element for emission and reception of an electromagnetic field. The wireless communication unit may comprise a receiver and/or transmitter, receiver-transmitter pair, transceiver, or a radio, thereby comprising both a receiver and a transmitter. Thus, the wireless communication unit interconnected with the antenna element provides that the antenna may be able to both emit and receive an electromagnetic field. The wireless communications unit may be configured for communication using any protocol as known for a person skilled in the art, including Bluetooth, including Bluetooth Low Energy, Bluetooth Smart, etc., WLAN standards, manufacture specific protocols, such as tailored proximity antenna protocols, such as proprietary protocols, such as low-power wireless communication protocols, such as CSR mesh, etc.

In some embodiments, the hearing device further comprises a fourth circuit board. Thus, the printed circuit board assembly comprises four circuit boards which are connected, such as interconnected, with each other. There are different ways by which the four circuit boards can be connected to each other. The four circuit boards may be different circuit boards, such as printed circuit boards and/or flexible circuit boards. The fourth circuit board may be a printed circuit board and may comprise electronic components, such as resistors, transistors, capacitors, inductors and diodes, connected by conductive wires or traces through which electric current can flow. The printed circuit board assembly may be folded about the battery and the fourth circuit board may be adjacent at least one of the one or more side faces. The fourth circuit board may be interconnected, via the third circuit board, with the first circuit board and the second circuit board. It is advantage that there is a fourth circuit board in the printed circuit board assembly, because thereby there is many circuit boards, and thus area, available for proving components and functionality. Thus, more components and functionality may be provided in the present hearing device than in other prior art hearing devices of the same small and compact size. It is an advantage that the printed circuit board assembly in the present hearing device may be larger than in other hearing devices, because thereby the functionality and performance of the hearing device may be increased.

In some embodiments, the wireless communication unit is provided at the fourth circuit board.

In some embodiments, the hearing device further comprises power management components. In some embodiments, the power management components are provided at the fourth circuit board. The power management components may comprise regulators for regulating the power. The power management components may comprise a power management chip which may implement power management circuits including power regulators. The power management components may be provided for controlling the power provided from the battery to a processing unit, an output transducer, microphone(s), a wireless communication unit. The power management components are provided at the fourth circuit board. Thereby the battery may provide shielding from the power management components on the fourth circuit board. The power management components may further be covered by a shielding can for providing improved shielding of the power management components.

In some embodiments, the hearing device further comprises an output transducer for providing the audio signal. In some embodiments, the printed circuit board assembly is folded about the battery and the output transducer. The output transducer may be a speaker, a loudspeaker, a receiver etc. The audio signal is provided in the ear canal of the user. It saves space in the hearing device when the printed circuit board assembly can be folded around the battery and the output transducer. Thereby, the hearing device can be small and compact. It is an advantage as this provides a space efficient packaging of the battery and output transducer.

In some embodiments the hearing device further comprises one or more microphones for generating one or more microphone output signals. The microphones may be configured for receiving sound from the surroundings. The received sound may be processed in a processing unit of the hearing device and provided to an output transducer of the hearing device. If the hearing device is a hearing aid, the sound received in the microphone(s) may be processed for compensating for a hearing loss of the user. The hearing device may further comprise one or more control interfaces for the microphones. The control interfaces may be configured for controlling functions of the hearing device, e.g. sound volume, modes etc. The one or more control interfaces may be provided as buttons on the external surface of the hearing device.

Optionally, the hearing device comprises two or more microphones. Optionally, at least one of the two or more microphones is/are an omnidirectional microphone and/or at least one of the two or more microphones is/are a directional microphone. Optionally, the hearing device comprises a beamforming arrangement adapted to generate a directional signal based on microphone signals provided by the two or more microphones.

In some embodiments, the one or more microphones are provided on the first circuit board. The one or more control interfaces for the one or more microphones may be provided on the first circuit board.

In some embodiments, the hearing device further comprises a signal processor for processing the one or more microphone output signals into the audio signal. The signal processor may be a digital signal processor.

In some embodiments, during operational use of the hearing device, the circuit assembly is arranged such that the third circuit board is provided adjacent the tragus in the ear. Thus, the third circuit board, which may be configured be a high-current or a maximum-current area, may be provided adjacent the tragus in the ear of the user. Simulation have shown that having the circuit assembly arranged such that the third circuit board is provided adjacent the tragus in the ear improves the antenna performance. Thus, the antenna performance is improved compared to if the hearing device is orientated differently in the ear.

In some embodiments, during operational use of the hearing device, the circuit assembly is arranged such that the first surface of the first circuit board faces towards the surroundings outside of the ear, and a second surface of the first circuit board faces towards the concha of the ear. In some embodiments, the first surface is opposite to the second surface. The at least part of the antenna element provided at the first circuit board may face towards the surroundings of the ear. This is an advantage as antenna performance may be improved.

In some embodiments, the printed circuit board assembly is configured to have antenna functionality due to the antenna element. The location of the feed of the antenna element adjacent the interconnection between the first and third circuit boards provides that an antenna mode is excited on the printed circuit board assembly, such that the printed circuit board assembly may be considered to be part of the antenna. The printed circuit board assembly being configured to have antenna functionality is an advantage as the antenna performance may be improved. Furthermore, as the printed circuit board assembly is folded about the battery, this provides a compact and improved antenna or antenna structure.

In some embodiments, the printed circuit board assembly is configured to have a maximum current at the third circuit board during use of the antenna. The location of the feed of the antenna or antenna element being provided in the portion of the first or third circuit board which is adjacent the interconnection between the first and third circuit boards provides that the printed circuit board assembly is configured to have a maximum current at the third circuit board during use of the antenna. Thus, the third circuit board may be a high-current or a maximum-current area. In other words, the current distribution of the antenna may have a maximum current amplitude at the third circuit board. As described above, the current distribution along the antenna may be changed by having the second end of the antenna element being connected to the ground plane through the first electronic component. It is an advantage having the printed circuit board assembly being configured to have a maximum current at the third circuit board as the antenna performance may be improved.

In some embodiments, the third circuit board has a length. In some embodiments, the length of the third circuit board is substantially parallel to an ear-to-ear axis of the user when the hearing device is worn in its operational position at the ear. In other words, a longitudinal direction of the third circuit board, such as a direction parallel to the direction of maximum elongation of the third circuit board, may be substantially parallel to an ear-to-ear axis of the user when the hearing device is worn in its operational position at the ear. The third circuit board may be a high-current or a maximum-current area. Thus, the current distribution of the antenna during use may have a maximum current amplitude at the third circuit board and the third circuit board may be orientated such that the length of the third circuit board is substantially parallel to an ear-to-ear axis of the user when the hearing device is worn in its operational position at the ear. The electrical field generated by the current flowing will also be substantially parallel to an ear-to-ear axis of the user when the hearing device is worn in its operational position at the ear. Hereby, the electromagnetic field emitted by the antenna may propagate along the surface of the user with its electrical field substantially orthogonal to the surface of the user, such that the electromagnetic field may reach another hearing device provided at the user's other ear and/or an another external device provided either separate from or on the user, e.g. a mobile phone in the user's pocket. Thus, a significant improvement with respect to antenna loss in the tissue of the head may be obtained. This is an advantage as the antenna performance may be improved.

In some embodiments, the third circuit board has a length of at least 4 mm, preferably at least 6 mm. In some embodiments, the third circuit board has a length of at least $\lambda/30$, preferably at least $\lambda/20$.

In some embodiment, the length of the third circuit board is parallel+/−25° to an ear-to-ear axis of the user when the hearing device is worn in its operational position at the ear.

In some embodiments, the hearing device further comprises a shell with a face plate. In some embodiments, a part of the antenna element is printed on the face plate.

In some embodiments, the antenna element may comprise a spring device for connecting the part of the antenna element which is printed on the faceplate to the part of the antenna element located on the first circuit board.

The hearing device may be a headset or earbud(s) for audio communication. The hearing device may be a hearing protector for protection of e.g. impulse sounds. The hearing device may be a hearing aid for compensating for a hearing loss of the user. The hearing aid may be any hearing aid, such as a hearing aid of the in-the-ear type, such as in-the-canal type, such as completely-in-the-canal type of hearing aid, etc., a hearing aid of the receiver-in-the-ear type of hearing aid, etc.

The hearing device may comprise a microphone configured for converting an acoustic sound signal from a sound source into an audio signal. The audio signal is configured to be processed in a processing unit for compensation of the hearing loss of the user. The processed audio signal is configured to be converted into a processed acoustic signal by an output transducer.

The hearing device may comprise one or more antennas for radio frequency communication. The one or more antenna may be configured for operation in ISM frequency band. One of the one or more antennas may be an electric antenna. One or the one or more antennas may be a magnetic induction coil antenna. Magnetic induction, or near-field magnetic induction (NFMI), typically provides communication, including transmission of voice, audio and data, in a range of frequencies between 2 MHz and 15 MHz. At these frequencies the electromagnetic radiation propagates through and around the human head and body without significant losses in the tissue.

The magnetic induction coil may be configured to operate at a frequency below 100 MHz, such as at below 30 MHz, such as below 15 MHz, during use. The magnetic induction coil may be configured to operate at a frequency range between 1 MHz and 100 MHz, such as between 1 MHz and 15 MHz, such as between 1 MHz and 30 MHz, such as between 5 MHz and 30 MHz, such as between 5 MHz and 15 MHz, such as between 10 MHz and 11 MHz, such as between 10.2 MHz and 11 MHz. The frequency may further include a range from 2 MHz to 30 MHz, such as from 2 MHz to 10 MHz, such as from 2 MHz to 10 MHz, such as from 5 MHz to 10 MHz, such as from 5 MHz to 7 MHz.

The electric antenna may be configured for operation at a frequency of at least 400 MHz, such as of at least 800 MHz, such as of at least 1 GHz, such as at a frequency between 1.5 GHz and 6 GHz, such as at a frequency between 1.5 GHz and 3 GHz such as at a frequency of 2.4 GHz. The antenna may be optimized for operation at a frequency of between 400 MHz and 6 GHz, such as between 400 MHz and 1 GHz, between 800 MHz and 1 GHz, between 800 MHz and 6 GHz, between 800 MHz and 3 GHz, etc. Thus, the electric antenna may be configured for operation in ISM frequency band. The electric antenna may be any antenna capable of operating at these frequencies, and the electric antenna may be a resonant antenna, such as monopole antenna, such as a dipole antenna, etc. The resonant antenna may have a length of $\lambda/4\pm10\%$ or any multiple thereof, $\lambda$ being the wavelength corresponding to the emitted electromagnetic field.

The hearing device may comprise one or more wireless communications unit(s) or radios. The one or more wireless communications unit(s) are configured for wireless data communication, and in this respect interconnected with the one or more antennas for emission and reception of an electromagnetic field. Each of the one or more wireless communication unit may comprise a transmitter, a receiver, a transmitter-receiver pair, such as a transceiver, and/or a radio unit. The one or more wireless communication units may be configured for communication using any protocol as known for a person skilled in the art, including Bluetooth, WLAN standards, manufacture specific protocols, such as tailored proximity antenna protocols, such as proprietary protocols, such as low-power wireless communication protocols, RF communication protocols, magnetic induction protocols, etc. The one or more wireless communication units may be configured for communication using same communication protocols, or same type of communication protocols, or the one or more wireless communication units may be configured for communication using different communication protocols.

The hearing device may be a binaural hearing device. The hearing device may be a first hearing device and/or a second hearing device of a binaural hearing device.

The hearing device may be a device configured for communication with one or more other device, such as configured for communication with another hearing device or with an accessory device or with a peripheral device.

The present disclosure relates to different aspects including the hearing device described above and in the following, and corresponding system parts, methods, devices, systems, networks, kits, uses and/or product means, each yielding one or more of the benefits and advantages described in connection with the first mentioned aspect, and each having one or more embodiments corresponding to the embodiments described in connection with the first mentioned aspect and/or disclosed in the appended claims.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1A:
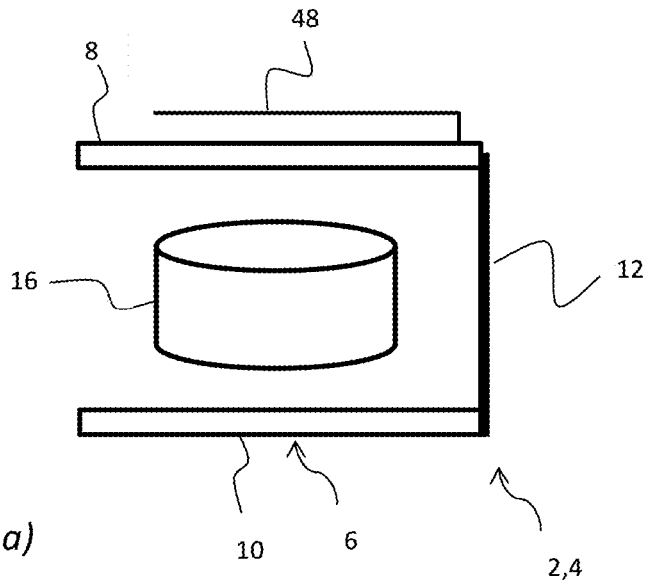
FIGS. 1*a*), 1*b*), and 1*c*) all schematically illustrates an example of a hearing device configured to be worn in an ear of a user.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

FIGS. 1*a*), 1*b*) and 1*c*) all schematically illustrates an example of a hearing device 2 configured to be worn in an ear of a user. FIG. 1*a*) shows a hearing device as viewed from a side, FIG. 1*b*) shows a hearing device as viewed from a side but rotated compared to FIG. 1*a*), and FIG. 1*c*) shows a hearing device as viewed from above. The hearing device 2 is configured to provide an audio signal to the user. The hearing device 2 comprises a circuit assembly 4. The circuit assembly 4 comprises a printed circuit board assembly 6. The printed circuit board assembly 6 comprises a first circuit board 8. The printed circuit board assembly 6 comprises a second circuit board 10. The printed circuit board assembly 6 comprises a third circuit board 12. The third circuit board 12 is provided between the first circuit 8 board and the second circuit board 10.

Figure 1B:
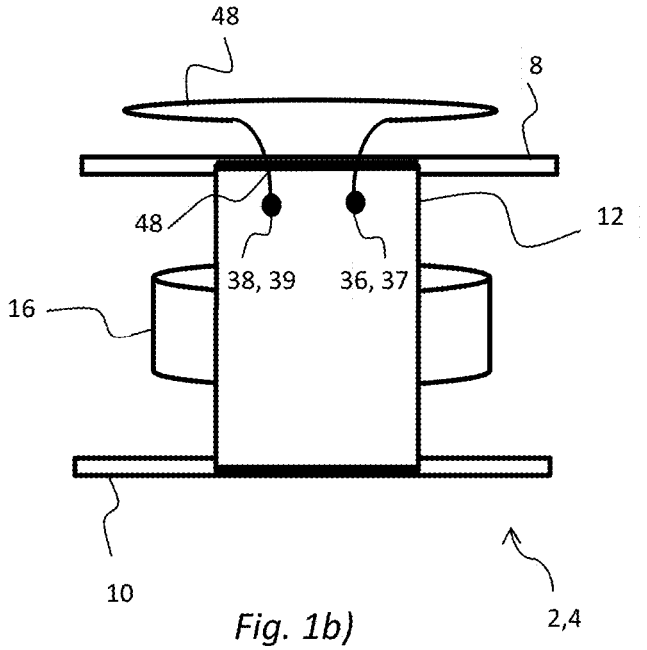
Figure 1C:
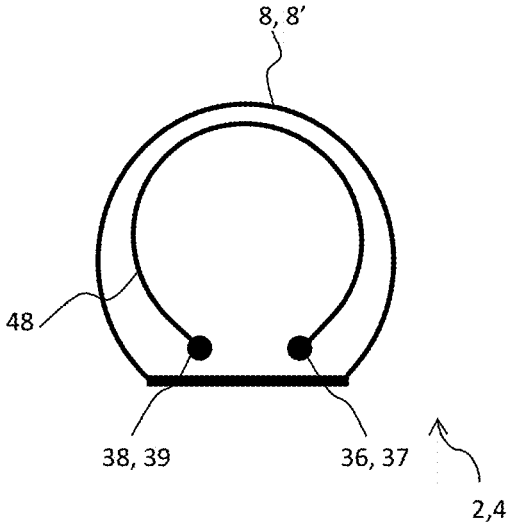

The third circuit board 12 is interconnected with the first circuit board 8 and the second circuit board 10. The circuit assembly 4 comprises a battery 16. The printed circuit board assembly 6 is folded about the battery 16. The circuit assembly 4 comprises an antenna. The antenna comprises an antenna element 48. The antenna is configured for emission and reception of electromagnetic radiation at a wavelength (λ). The antenna element 48 has a first end 36. The first end 36 is connected to a feed 37. The feed 37 is provided in a portion of the first circuit board 8 which is adjacent the interconnection between the first 8 and third circuit 12 boards, or the feed 37 is provided in a portion of the third circuit board 12 which is adjacent the interconnection between the first 8 and third 12 circuit boards. An example of the feed being provided in a portion of the first circuit board 8 which is adjacent the interconnection between the first 8 and third circuit 12 boards is shown in FIG. 1*c*). An example of the feed 37 being provided in a portion of the third circuit board 12 which is adjacent the interconnection between the first 8 and third 12 circuit boards is shown in FIG. 1*b*).

The antenna element 48 extends from the feed 37 onto the first circuit board 8.

The distance from the feed 37 to the interconnection between the first 8 and third 12 circuit boards is less than 5 mm and/or less than λ/24.

The feed 37 may be provided in a portion of the first circuit board 8 which is adjacent the third circuit board 12. An example of this is shown in FIGS. 1*a*) and 1*c*).

At least a part of the antenna element 48 may be printed on the first circuit board 8. An example of at least a part of the antenna element being printed on the first circuit board 8 is shown in FIG. 1*c*). FIGS. 1*a*) and 1*b*) show the antenna element 48 as a separate part connected to the printed circuit board assembly 6.

At least a part of the antenna element 48 may be provided at the first circuit board 8. An example of at least a part of the antenna element being provided at the first circuit 8 is shown in FIGS. 1*a*) and 1*c*).

The antenna element 48 extends across a first surface 8' of the first circuit board 8.

The antenna element 48 has a second end 38 connected to an end point 39 provided at the first 8 or third 12 circuit board. An example of the end point 39 being provided at the first circuit board 8 is shown in FIG. 1*c*). An example of the end point 39 being provided at the third circuit board 12 is shown in FIG. 1*b*).

The end point 39 is provided in a portion of the first 8 or third 12 circuit board which is adjacent the interconnection between the first 8 and third 12 circuit boards. An example of the end point 39 being provided in a portion of the first circuit board 8 which is adjacent the interconnection between the first 8 and third 12 circuit boards is shown in FIG. 1.*c*. An example of the end point 39 being provided in a portion of the third circuit board 12 which is adjacent the interconnection between the first 8 and third 12 circuit boards is shown in FIG. 1.*b*.

The feed of the antenna element is configured to excite the second 10 and third 12 circuits boards.

The third circuit board 12 is connected to the first circuit board 8 in proximity of the feed 37.

The second end 38 of the antenna element 48 is connected to a ground plane.

Figure 2:
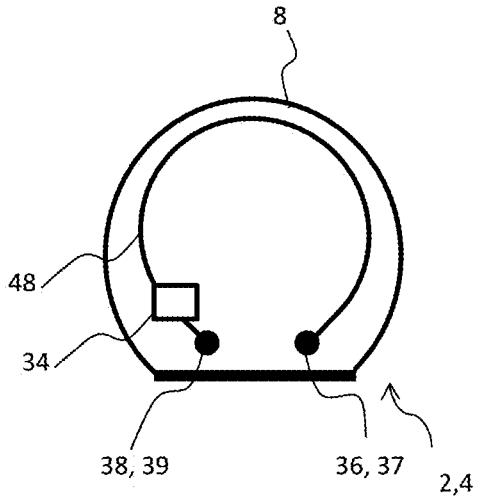
FIG. 2 schematically illustrates an example of a hearing device configured to be worn in an ear of a user.

FIG. 2 schematically illustrates an example of a hearing device 2 configured to be worn in an ear of a user. FIG. 2 comprises all features of FIG. 1*c*.

Additionally, the second end 39 of the antenna element 48 is connected to a ground plane through a first electronic component 34.

The antenna element may be configured to have an electrical length corresponding to about λ/2.

The antenna element may be configured to have an electrical length corresponding to about λ/4 to λ/2.

Figure 3:
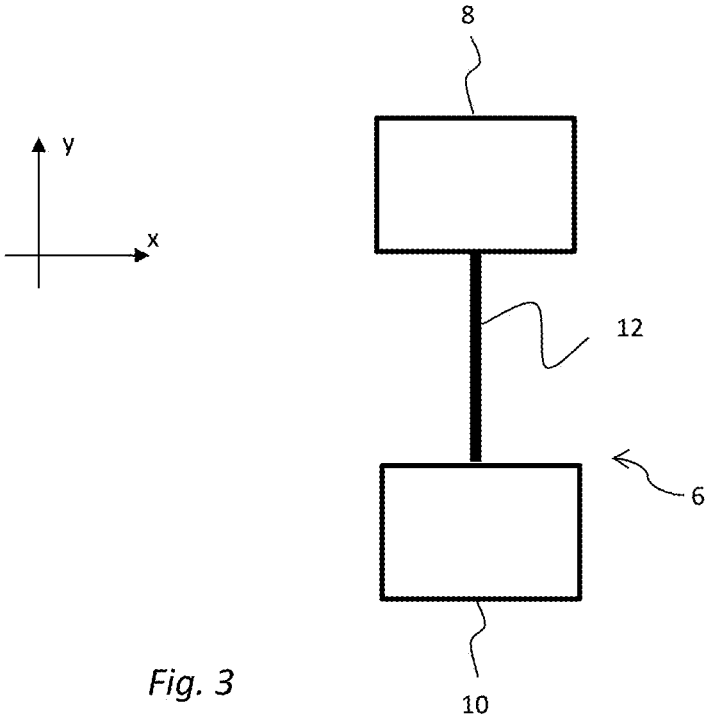
FIG. 3 schematically illustrates an example of a printed circuit board assembly when unfolded.

FIG. 3 schematically illustrates an example of a printed circuit board assembly 6 when unfolded. A coordinate system defining an x-axis and a y-axis is also illustrated.

The first 8 and second 10 circuit boards are printed circuit boards. The third circuit board 12 is a flexible circuit board.

The third circuit board 12 has a width. The width of the third circuit board 12 extends in the direction of the x-axis. The third circuit board 12 is connected to the first 8 and the second 10 circuit boards along it entire width.

The third circuit board 12 has a length. The length of the third circuit board 12 extends in the direction of the y-axis.

Figure 4:
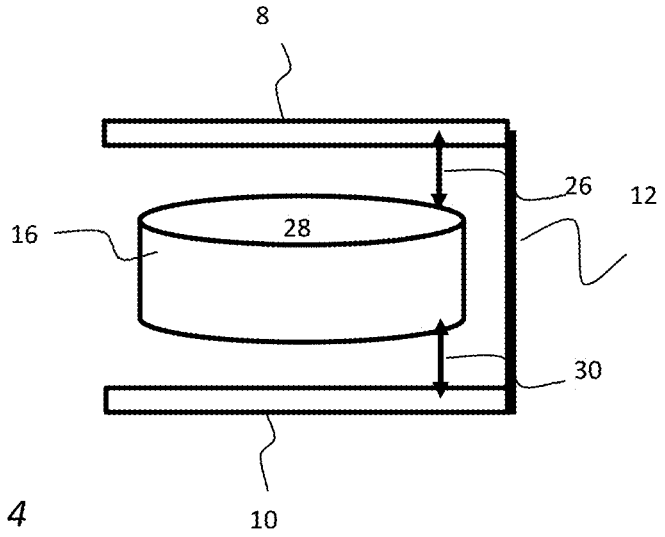
FIG. 4 schematically illustrates an example of a first/second distance between the battery and the first/second circuit board.

FIG. 4 schematically illustrates an example of a first 26/second 30 distance between the battery 16 and the first 8/second 10 circuit board.

The battery 16 comprises a first major face 28, a second major face (not shown, as it is the face of the battery pointing downwards in the figure) and one or more side faces. The printed circuit board assembly 6 is folded about the battery 16. The printed circuit board assembly 6 is folded about the battery 16 with the first circuit board 8 adjacent the first major face 28, the second circuit board 10 adjacent the second major face, and the third circuit board 12 adjacent the one or more side faces.

The hearing device 2 further comprises a first distance 26 between the first major face 28 of the battery 16 and the first circuit board 8, the first distance 26 having a first predefined value. The hearing device 2 comprises a second distance 30 between the second major face of the battery 16 and the second circuit board 12, the second distance 30 having a second predefined value.

The first distance 26 is 200-400 micrometer, preferably about 300 micrometer. The second distance 30 is 200-400 micrometer, preferably about 300 micrometer.

Figure 5:
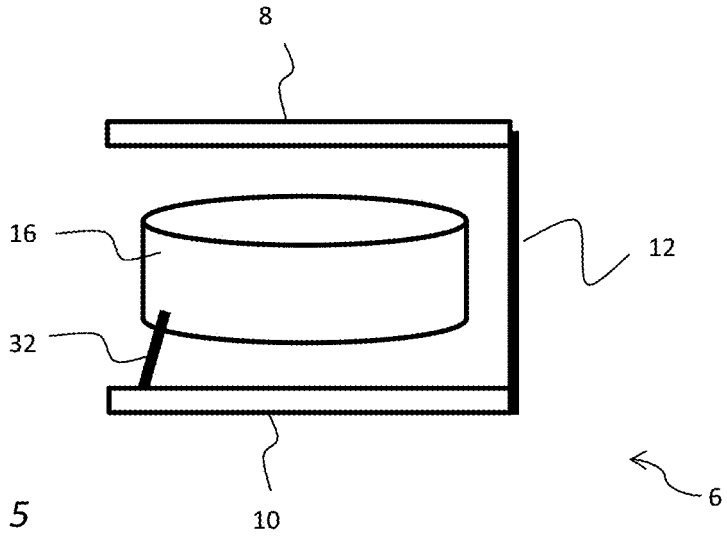
FIG. 5 schematically illustrates an example of the battery being connected to the printed circuit board assembly through a second electronic component.

FIG. 5 schematically illustrates an example of the battery 16 being connected to the printed circuit board assembly 6 through a second electronic component.

The battery 16 is connected to the printed circuit board assembly 6 through a second electronic component 32.

The second electronic component 32 is configured to electrically decouple the battery 16 and the printed circuit board assembly 6 at a first frequency, corresponding to the wavelength (λ), while maintaining an electrical connection between the battery 16 and the printed circuit board assembly 6 at second frequencies.

Figure 6:
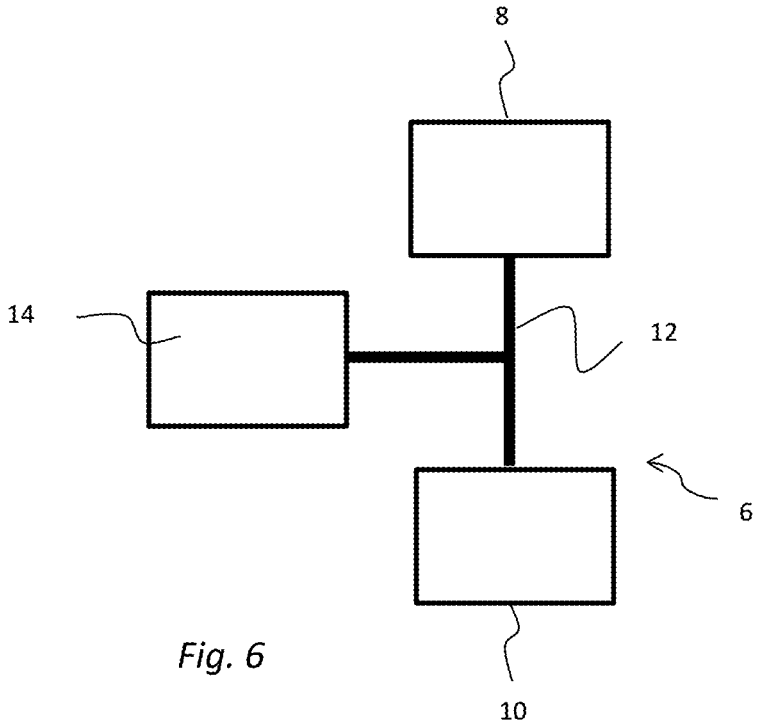
FIG. 6 schematically illustrates an example of a printed circuit board assembly when unfolded.

FIG. 6 schematically illustrates an example of a printed circuit board assembly 6 when unfolded. The printed circuit board further comprises a fourth circuit board 14.

Figure 7A:
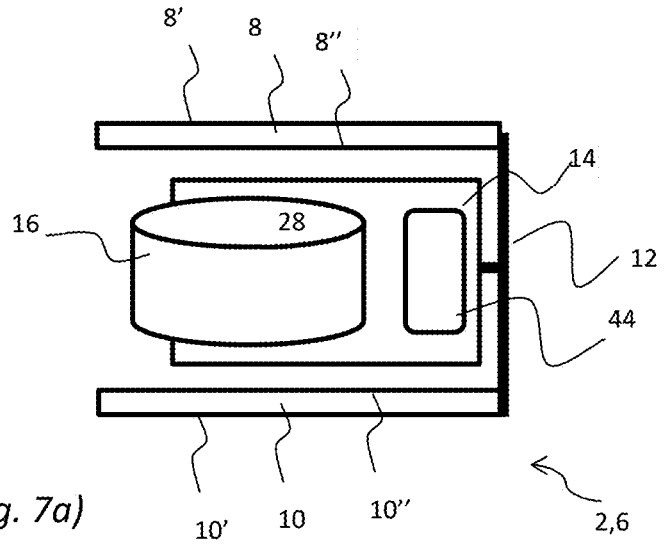
FIG. 7*a*), b), c) and d) schematically illustrates an example of a hearing device configured to be worn in an ear of a user.

FIG. 7*a*), b), c) and d) schematically illustrates an example of a hearing device 2 configured to be worn in an ear of a user. The hearing device 2 is configured to provide an audio signal to the user. The hearing device 2 comprises a circuit assembly 4. The circuit assembly 4 comprises a printed circuit board assembly 6. The printed circuit board assembly 6 comprises: a first circuit board 8; a second circuit board 10; and a third circuit board 12 interconnected with the first circuit board 8 and the second circuit board 10, and a fourth circuit board 14.

The hearing device may further comprise a wireless communication unit (not shown) interconnected with the antenna element. FIG. 7*d*) shows the antenna element 48 on the first circuit board 8.

The wireless communication unit may be provided at the fourth circuit board 14.

Figure 7B:
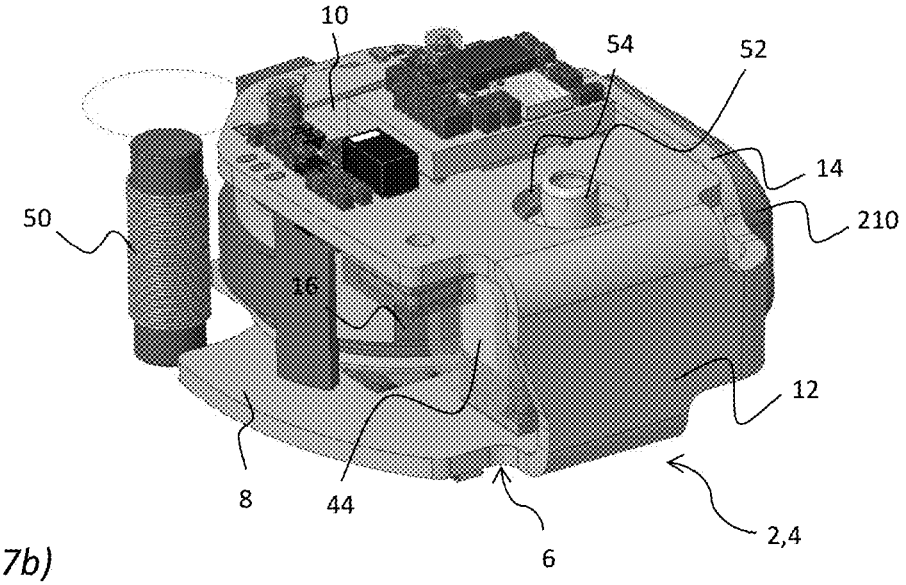
Figure 7C:
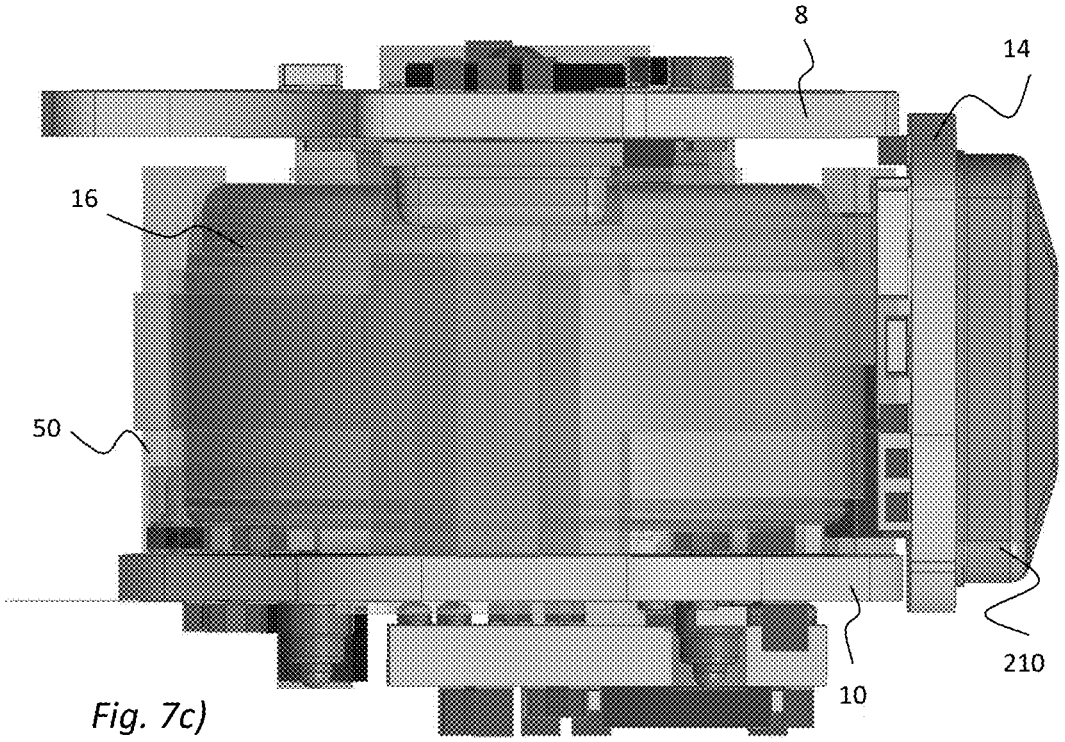
Figure 7D:
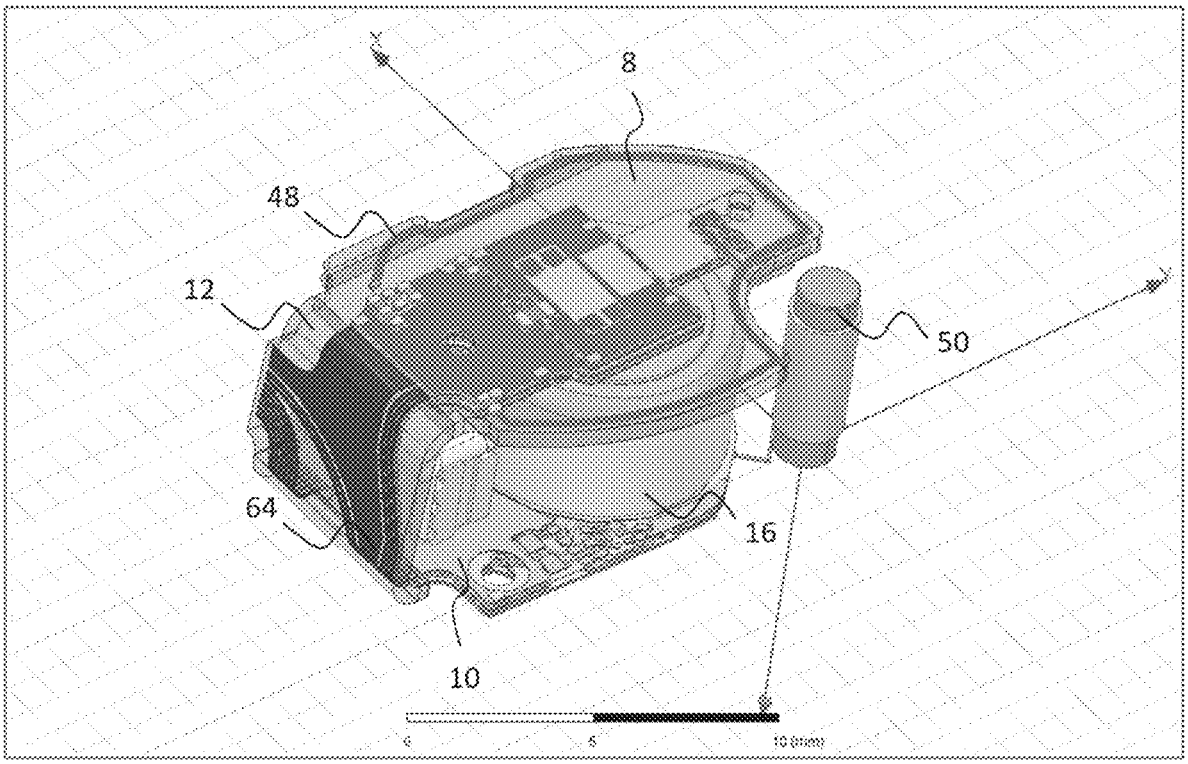

FIG. 7*b*) and c) shows that the hearing device comprises power management components 210. The power management components 210 are provided at the fourth circuit board 14.

FIG. 7*a*) and b) shows that the hearing device 2 comprises an output transducer 44 for providing the audio signal. The printed circuit board 6 assembly is folded about the battery 16 and the output transducer 44.

FIG. 7*b*) shows that the output transducer 44 comprises a protrusion 52 for providing a sound output. The second circuit board 10 comprises a hole 54. The protrusion 52 extends through the hole 54.

FIG. 7*b*), c) and d) shows a magnetic induction coil 50.

FIG. 7*b*) shows that the magnetic induction coil 50 is provided opposite the output transducer 44. The battery 16 is arranged between the magnetic induction coil 50 and the output transducer 44.

The hearing device may further comprise one or more microphones (not shown) for generating one or more microphone output signals.

The one or more microphones may be provided on the first circuit board 8.

The hearing device may further comprise a signal processor (not shown) for processing the one or more microphone output signals into the audio signal.

FIG. 7*d*) shows that the third circuit board 12 comprises conductive wires 64 or traces through which electric current can flow. One or more of the printed circuit boards 8, 10, 14 are connected with the third circuit board 12. The conductive wires 64 or traces of one or more of the printed circuit boards 8, 10, 14 are connected with or extends as the conductive wires or traces of the third circuit board 12.

Figure 8:
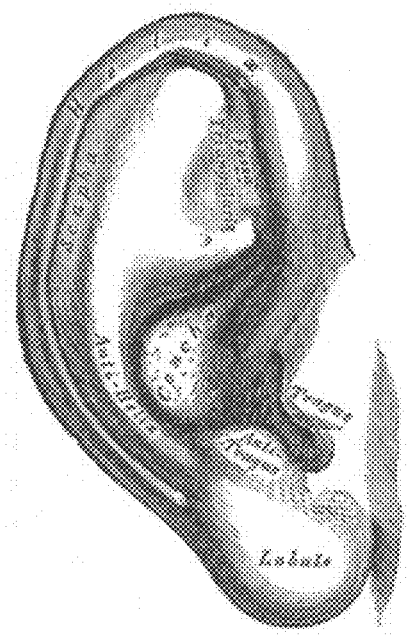
FIG. 8 shows an illustration of ear anatomy.

FIG. 8 shows an illustration of ear anatomy.

Figure 9:
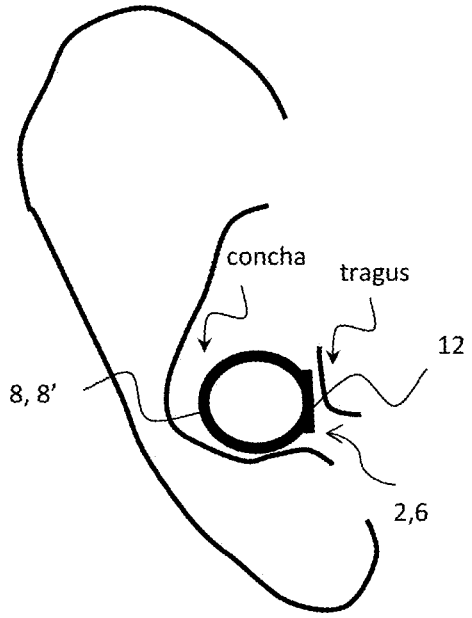
FIG. 9 schematically illustrates an example of the position of the hearing device in the ear during operational use of the hearing device.

FIG. 9 schematically illustrates an example of the position of the hearing device 2 in the ear during operational use of the hearing device.

During operational use of the hearing device 2, the circuit assembly 6 is arranged such that the third circuit board 12 is provided adjacent the tragus in the ear.

During operational use of the hearing device 2, the circuit assembly 6 is arranged such that the first surface 8' of the first circuit board 8 faces towards the surroundings outside of the ear, and a second surface of the first circuit board (not shown as it is the face of the first circuit board that is pointing into the paper) faces towards the concha of the ear. Thus, the first surface 8' of the first circuit board 8 is opposite to the second surface of the first circuit board 8.

The printed circuit board assembly is configured to have antenna functionality due to the antenna element.

The printed circuit board assembly is configured to have a maximum current at the third circuit board 12.

The third circuit board 12 has a length. The length of the circuit board is illustrated in FIG. 3. The length of the third circuit board 12 is substantially parallel to an ear-to-ear axis of the user when the hearing device is worn in its operational position at the ear. The ear-to-ear axis is illustrated in FIG. 9.

The third circuit board may have a length of at least 4 mm. In some embodiments, the third circuit board has a length of at least $\lambda/30$.

The length of the third circuit board may be parallel+/−25° to an ear-to-ear axis of the user when the hearing device is worn in its operational position at the ear. The ear-to-ear axis is illustrated in FIG. 9.

Figure 10:
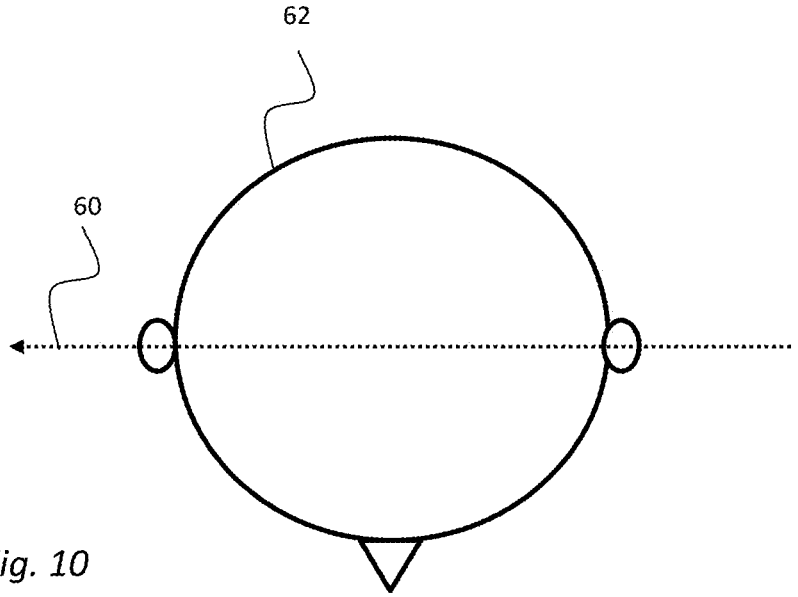
FIG. 10 schematically illustrates a user's head as view from above and an ear-to-ear axis.

FIG. 10 schematically illustrates a user's head 62 as view from above and an ear-to-ear axis 60.

The head of a user 62 is viewed from above, illustrated with a nose protruding from the head and pointing towards the bottom of the page, and two ears protruding from the head, each pointing toward the right and left margin of the paper, respectively. An ear-to-ear axis 60 is illustrated as going through the head, from ear to ear.

Figure 11:
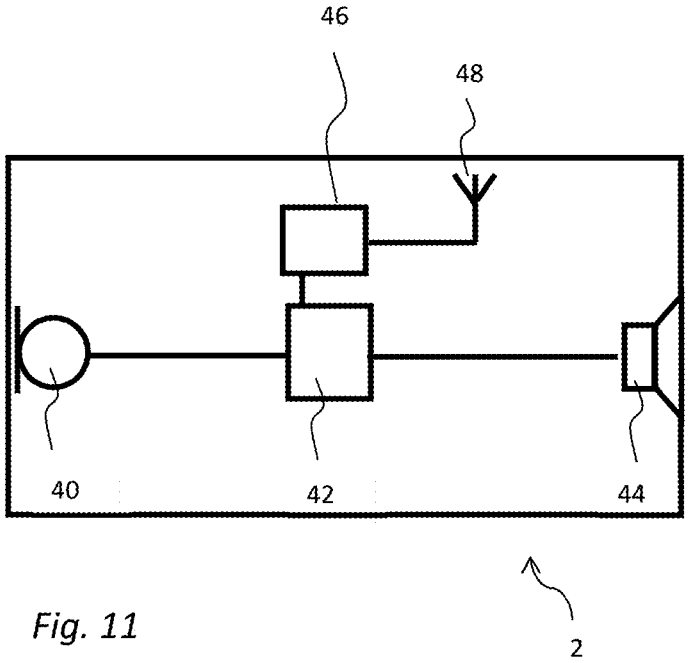
FIG. 11 schematically illustrates an example of a hearing device, such as a hearing aid.

FIG. 11 schematically illustrates an example of a hearing device 2, such as a hearing aid. The hearing device 2 comprises a microphone 40, for receiving an input signal and converting it into an audio signal. The audio signal is provided to a processing unit 42 for processing the audio signal and providing a processed output signal for compensating a hearing loss of a user of the hearing device 2. An output transducer 44 is connected to an output of the processing unit 42 for converting the processed output signal into an output sound signal, e.g. a signal modified to compensate for a user's hearing impairment. The output transducer 44 is often referred to as a receiver or speaker. The processing unit 42 may comprise elements such as amplifiers, compressors, noise reduction systems, etc. The hearing device 2 may further comprise a wireless communication unit 46 for wireless data communication interconnected with an antenna element/structure 48 for emission and reception of an electromagnetic field. The wireless communication unit 46, such as a radio or a transceiver, connects to the processing unit 42 and the antenna structure 48, for communicating with an electronic device, an external device, or with another hearing device, such as another hearing aid located in/on/at another ear of the user, typically in a binaural hearing system. The hearing device 2 may comprise two or more antenna structures.

The hearing device 2 may be an in-the-ear hearing device and may be provided as an in-the-ear module. Alternatively, parts of the hearing device 2 may be provided in a behind-the-ear module, while other parts, such as the output transducer 44, may be provided in an in-the-ear module.

Figure 12A:
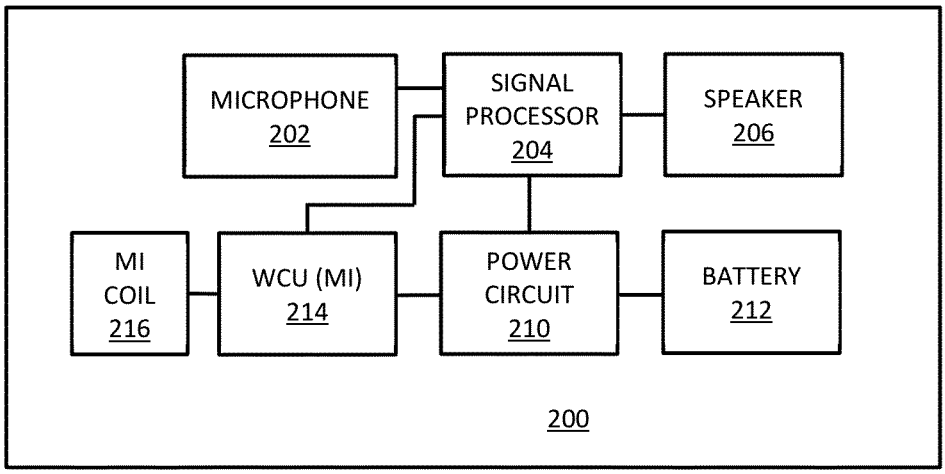
FIGS. 12*a*) and 12*b*) schematically illustrate an example of a block-diagram of an embodiment of a hearing device.
Figure 12B:
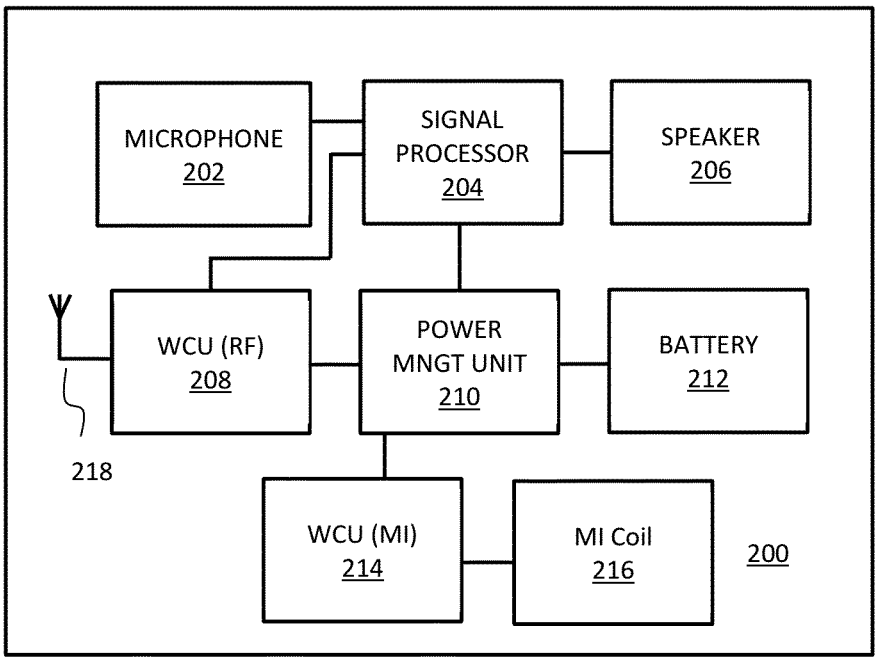

FIGS. 12*a*) and 12*b*) schematically illustrate an example of a block-diagram of an embodiment of a hearing device 200. In FIG. 8*a*), the hearing device 200 comprises a first transducer, i.e. microphone 202, to generate one or more microphone output signals based on a received an audio signal. The one or more microphone output signals are provided to a signal processor 204 for processing the one or more microphone output signals. An output transducer or receiver or speaker 206 is connected to an output of the signal processor 204 for converting the output of the signal processor into a signal modified to compensate for a user's hearing impairment, and provides the modified signal to the speaker 206.

The hearing device signal processor 204 may comprise elements such as an amplifier, a compressor and/or a noise reduction system etc. The signal processor 204 may be implemented in a signal processing chip 204'. The hearing device may further have a filter function, such as compensation filter for optimizing the output signal.

The hearing device further comprises a wireless communication unit 214 interconnected with magnetic induction antenna 216 such as a magnetic induction coil. The wireless communication unit 214 and the magnetic induction antenna 216 may be configured for wireless data communication using emission and reception of magnetic field. The wireless communication unit may be implemented as a wireless communication chip 214', such as a magnetic induction control chip 214'. The hearing device 200 further comprises a power source 212, such as a battery or a rechargeable battery. Furthermore, a power management unit 210 is provided for controlling the power provided from the battery 212 to the signal processor 204, the output transducer, the one or more microphones, the wireless communication unit (RF) 208, and the wireless communication unit (MI) 214. The magnetic induction antenna is configured for communication with another electronic device, in some embodiments configured for communication with another hearing device, such as another hearing device located at another ear, typically in a binaural hearing device system.

The hearing device may furthermore have a wireless communication unit 208, such as a wireless communication circuit, for wireless data communication interconnected with an RF antenna 218 for emission and reception of an electromagnetic field. The wireless communication unit may be implemented as a wireless communication chip 208'. The wireless communication unit 208, including a radio or a transceiver, connect to the hearing device signal processor 204 and the RF antenna 218, for communicating with one or more external devices, such as one or more external electronic devices, including at least one smart phone, at least one tablet, at least one hearing accessory device, including at least one spouse microphone, remote control, audio testing device, etc., or, in some embodiments, with another hearing device, such as another hearing device located at another ear, typically in a binaural hearing device system.

The signal processor 204, the wireless communication unit (RF) 208, the wireless communication unit (MI) 214 and the power management unit 210 may be implemented as signal processing chip 204', wireless communication chip (RF) 208', wireless communication chip (MI) 214' and power management chip 210', respectively.

In FIG. 8*b*), a hearing device corresponding to the hearing device as shown in FIG. 8*a*) is seen, except that in FIG. 8*b*), only one wireless communication unit 214 is present being interconnected with the magnetic induction antenna 216, the signal processor 204 and the power management unit 210.

Likewise, even though not shown, also a hearing device having only one wireless communication unit 208 being interconnected with an RF antenna for reception and emission of an electromagnetic field is envisaged.

As used in this specification, the term "about λ/2" refers to a value that is λ/2, or any value that does not vary from λ/2 by more than 10% (e.g., λ/2+/−10%*λ/2).

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

Items

1. A hearing device configured to be worn in an ear of a user, the hearing device being configured to provide an audio signal to the user, the hearing device comprising:
   - a circuit assembly, comprising:
     - a printed circuit board assembly, comprising:
       - a first circuit board;
       - a second circuit board;
       - a third circuit board provided between, and interconnected with, the first circuit board and the second circuit board;
   - a battery, wherein the printed circuit board assembly is folded about the battery; and
   - an antenna comprising an antenna element, the antenna being configured for emission and reception of electromagnetic radiation at a wavelength (λ);

wherein the antenna element has a first end connected to a feed, wherein the feed is provided in a portion of the first or third circuit board which is adjacent the interconnection between the first and third circuit boards.

2. The hearing device according item 1, wherein the antenna element extends from the feed onto the first circuit board.

3. The hearing device according to any of the preceding items, wherein the distance from the feed to the interconnection between the first and third circuit boards is less than 5 mm and/or less than λ/24.

4. The hearing device according to any of the preceding items, wherein the feed is provided in a portion of the first circuit board which is adjacent the third circuit board.

5. The hearing device according to any of the preceding items, wherein at least a part of the antenna element is printed on the first circuit board.

6. The hearing device according to any of the preceding items, wherein at least a part of the antenna element is provided at the first circuit board.

7. The hearing device according to any of the preceding items, wherein the antenna element extends across a first surface of the first circuit board.

8. The hearing device according to any of the preceding items, wherein the antenna element has a second end connected to an end point provided at the first or third circuit board.

9. The hearing device according to any of the preceding items, wherein the end point is provided in a portion of the first or third circuit board which is adjacent the interconnection between the first and third circuit boards.

10. The hearing device according to any of the preceding items, wherein the feed of the antenna element is configured to excite the second and third circuits boards.

11. The hearing device according to any of the preceding items, wherein the third circuit board is connected to the first circuit board in proximity of the feed.

12. The hearing device according to any of the preceding items, wherein the second end of the antenna element is connected to a ground plane.

13. The hearing device according to any of the preceding items, wherein the second end of the antenna element is connected to the ground plane through a first electronic component.

14. The hearing device according to any of the preceding items, wherein the antenna element is configured to have an electrical length corresponding to about λ/2.

15. The hearing device according to any of the preceding items, wherein the antenna element is configured to have an electrical length corresponding to about λ/4 to λ/2.

16. The hearing device according to any of the preceding items, wherein the first and second circuit boards are printed circuit boards, and wherein the third circuit board is a flexible circuit board.

17. The hearing device according to any of the preceding items, wherein the third circuit board has a width, and wherein the third circuit board is connected to the first and the second circuit boards along it entire width.

18. The hearing device according to any of the preceding items, wherein the battery comprises a first major face, a second major face and one or more side faces; and wherein the printed circuit board assembly is folded about the battery with the first circuit board adjacent the first major face, the second circuit board adjacent the second major face and the third circuit board adjacent the one or more side faces.

19. The hearing device according to any of the preceding items, further comprising a first distance between the first major face of the battery and the first circuit board, the first distance having a first predefined value; and/or a second distance between the second major face of the battery and the second circuit board, the second distance having a second predefined value.

20. The hearing device according to any of the preceding items, wherein the first distance and/or the second distance is 200-400 micrometer, preferably about 300 micrometer.

21. The hearing device according to any of the preceding items, wherein the battery is connected to the printed circuit board assembly through a second electronic component.

22. The hearing device according to any of the preceding items, wherein the second electronic component is configured to electrically decouple the battery and the printed circuit board assembly at a first frequency, the first frequency corresponding to the wavelength (λ), while maintaining an electrical connection between the battery and the printed circuit board assembly at second frequencies.

23. The hearing device according to any of the preceding items, further comprising a wireless communication unit interconnected with the antenna element.

24. The hearing device according to any of the preceding items, further comprising a fourth circuit board.

25. The hearing device according to any of the preceding items, wherein the wireless communication unit is provided at the fourth circuit board.

26. The hearing device according to any of the preceding items, further comprising power management components, wherein the power management components are provided at the fourth circuit board.

27. The hearing device according to any of the preceding items, further comprising an output transducer for providing the audio signal, and wherein the printed circuit board assembly is folded about the battery and the output transducer.

28. The hearing device according to any of the preceding items, further comprising one or more microphones for generating one or more microphone output signals.

29. The hearing device according to any of the preceding items, wherein the one or more microphones are provided on the first circuit board.

30. The hearing device according to any of the preceding items, wherein the hearing device further comprises a signal processor for processing the one or more microphone output signals into the audio signal.

31. The hearing device according to any of the preceding items, wherein, during operational use of the hearing device, the circuit assembly is arranged such that the third circuit board is provided adjacent the tragus in the ear.

32. the hearing device according to any of the preceding items, wherein, during operational use of the hearing device, the circuit assembly is arranged such that the first surface of the first circuit board faces towards the surroundings outside of the ear, and a second surface of the first circuit board faces towards the concha of the ear, where the first surface is opposite to the second surface.

33. The hearing device according to any of the preceding items, wherein the printed circuit board assembly is configured to have antenna functionality due to the antenna element.

34. The hearing device according to any of the preceding items, wherein the printed circuit board assembly is configured to have a maximum current at the third circuit board.

35. The hearing device according to any of the preceding items, wherein the third circuit board has a length, the length of the third circuit board being substantially parallel to an ear-to-ear axis of the user when the hearing device is worn in its operational position at the ear.

36. The hearing device according to any of the preceding items, wherein the third circuit board has a length of at least 4 mm and/or λ/30.

37. The hearing device according to any of the preceding items, wherein the length of the third circuit board being parallel+/−25° to an ear-to-ear axis of the user when the hearing device is worn in its operational position at the ear.

38. The hearing device according to any of the preceding items, further comprising a shell with a face plate, wherein a part of the antenna element is printed on the face plate.

39. The hearing device according to any of the preceding items, wherein the antenna element comprises a spring device for connecting the part of the antenna element which is printed on the faceplate to the part of the antenna element located on the first circuit board.

LIST OF REFERENCES

2 hearing device
4 circuit assembly
6 printed circuit board assembly
8 first circuit board
8' first surface of first circuit board
8" second surface of first circuit board
10 second circuit board
10' first surface of second circuit board
10" second surface of second circuit board
12 third circuit board
14 fourth circuit board
16 battery
26 first distance
28 first major face 28
30 second distance
32 second electronic component
34 first electronic component
36 first end
37 feed
38 second end
39 end point
40 microphone
42 processing unit
44 output transducer
46 wireless communication unit
48 antenna element/structure
50 magnetic induction (MI) coil
52 protrusion
54 hole
60 ear to ear axis
62 user's head
64 conductive wires or traces
200 hearing device
202 first transducer
204 signal processor
206 output transducer
208 wireless communication unit/chip (RF)
210 power management components
214 wireless communication unit/chip (MI)

The invention claimed is:

1. A hearing device configured to be worn in an ear of a user, the hearing device being configured to provide an audio signal to the user, the hearing device comprising:

a printed circuit board assembly, comprising:

a first circuit board, a second circuit board, and a third circuit board connected between the first circuit board and the second circuit board;

a battery, wherein the printed circuit board assembly is folded about the battery; and an antenna comprising an antenna element, the antenna being configured for electromagnetic radiation emission at a wavelength (λ) and electromagnetic radiation reception at the wavelength;

wherein the first circuit board has a first portion at a free end of the first circuit board, and a second portion opposite from the first portion;

wherein the antenna element has a first end connected to a feed; and wherein the feed is at the first circuit board or at the third circuit board, and is located closer to the second portion of the first circuit board than to the first portion of the first circuit board.

2. The hearing device according to claim 1, wherein at least a part of the antenna element is printed on the first circuit board.

3. The hearing device according to claim 1, wherein at least a part of the antenna element is at the first circuit board.

4. The hearing device according to claim 1, wherein the antenna element extends across a first surface of the first circuit board.

5. The hearing device according to claim 1, wherein the antenna element has a second end connected to an end point at the first circuit board or at the third circuit board.

6. The hearing device according to claim 5, wherein the end point is at a portion of the first circuit board or the third circuit board, and is located closer to the second portion of the first circuit board than to the first portion of the first circuit board.

7. The hearing device according to claim 1, wherein the feed of the antenna element is configured to excite the second circuit board and the third circuit board.

8. The hearing device according to claim 1, wherein the antenna element has a second end connected to a ground plane, the second end being opposite from the first end.

9. The hearing device according to claim 8, further comprising a first electronic component, wherein the second end of the antenna element is connected to the ground plane through the first electronic component.

10. The hearing device according to claim 1, wherein the antenna element has an electrical length corresponding to about λ/2.

11. The hearing device according to claim 1, wherein the first circuit board and the second circuit board are printed circuit boards, and wherein the third circuit board is a flexible circuit board.

12. The hearing device according to claim 1, wherein the third circuit board has a width, and wherein the third circuit board is connected to the first and the second circuit boards along an entirety of the width of the third circuit board.

13. The hearing device according to claim 1, wherein the battery comprises a first major face, a second major face, and one or more side faces; and wherein the printed circuit board assembly is folded about the battery, with the first circuit board facing the first major face, with the second circuit board facing the second major face, and with the third circuit board facing the one or more side faces.

14. The hearing device according to claim 13, the first major face of the battery is at a first distance from the first circuit board; and/or the second major face of the battery is at a second distance from the second circuit board.

15. The hearing device according to claim 14, wherein the first distance is 200-400 micrometer, and/or the second distance is 200-400 micrometer.

16. The hearing device according to claim 1, wherein the first circuit board, the second circuit board, and the third circuit board are parts of a unity structure.

17. The hearing device according to claim 1, wherein the first circuit board, the second circuit board, and the third circuit board comprise respective parts of a substrate.

* * * * *